US011308895B2

(12) United States Patent
Zhu

(10) Patent No.: US 11,308,895 B2
(45) Date of Patent: Apr. 19, 2022

(54) LIQUID CRYSTAL DISPLAY DEVICE, IMAGE DISPLAYING METHOD THEREOF, AND BACKLIGHT CONTROL DEVICE FOR LOCAL DIMMING

(71) Applicant: TCL CHINA STAR OPTOELECTRONICS TECHNOLOGY CO., LTD., Shenzhen (CN)

(72) Inventor: Jiang Zhu, Shenzhen (CN)

( * ) Notice: Subject to any disclaimer, the term of this patent is extended or adjusted under 35 U.S.C. 154(b) by 186 days.

(21) Appl. No.: 16/625,715

(22) PCT Filed: Nov. 12, 2019

(86) PCT No.: PCT/CN2019/117315
§ 371 (c)(1),
(2) Date: Dec. 22, 2019

(87) PCT Pub. No.: WO2021/022704
PCT Pub. Date: Feb. 11, 2021

(65) Prior Publication Data

US 2021/0335283 A1 Oct. 28, 2021

(30) Foreign Application Priority Data

Aug. 6, 2019 (CN) ..... 201910721486.0

(51) Int. Cl.
*G09G 3/34* (2006.01)
*G09G 3/36* (2006.01)

(52) U.S. Cl.
CPC ..... *G09G 3/342* (2013.01); *G09G 3/3611* (2013.01); *G09G 2320/066* (2013.01); *G09G 2320/0646* (2013.01); *G09G 2360/16* (2013.01)

(58) Field of Classification Search
None
See application file for complete search history.

(56) References Cited

U.S. PATENT DOCUMENTS

2012/0113155 A1 5/2012 Fang et al.
2014/0098079 A1* 4/2014 Takayanagi ..... G09G 3/3426 345/207
2015/0356905 A1* 12/2015 Watanabe ..... G09G 5/003 345/88
2016/0379575 A1* 12/2016 Kawai ..... G09G 3/3611 345/694

(Continued)

FOREIGN PATENT DOCUMENTS

CN 101900280 A 12/2010
CN 106782377 A 5/2017

(Continued)

*Primary Examiner* — Chad M Dicke

(57) ABSTRACT

The present disclosure provides a liquid crystal display device, an image displaying method thereof, and a backlight control device by disposing the backlight control device between a backlight module and a liquid crystal display panel, wherein the backlight control device divides an image into a plurality of pixel units, calculates corresponding dimming coefficients of the pixel units, and adjusts a first optical signal output by the backlight module according to a plurality of dimming coefficients to output a plurality of second optical signals, thereby achieving local dimming and improving display contrast of the liquid crystal display device.

11 Claims, 2 Drawing Sheets

(56) References Cited

U.S. PATENT DOCUMENTS

| | | | | |
|---|---|---|---|---|
| 2017/0186380 | A1 | 6/2017 | Wallener et al. | |
| 2019/0310521 | A1 | 10/2019 | Chen | |
| 2020/0292894 | A1* | 9/2020 | Liu | G02F 1/13306 |

FOREIGN PATENT DOCUMENTS

| | | | |
|---|---|---|---|
| CN | 106782382 | A | 5/2017 |
| CN | 106328071 | B | 9/2018 |
| WO | 2010039419 | A1 | 4/2010 |

* cited by examiner

LIQUID CRYSTAL DISPLAY DEVICE, IMAGE DISPLAYING METHOD THEREOF, AND BACKLIGHT CONTROL DEVICE FOR LOCAL DIMMING

FIELD OF INVENTION

The present disclosure relates to the field of display technologies, and more particularly, to a liquid crystal display device, an image displaying method thereof, and a backlight control device.

BACKGROUND OF INVENTION

With development of economy and technology, LCD TVs have been widely used, and requirements for display effects of LCD TVs are getting higher. To meet customers' requirements for display effects of LCD TVs, display contrast needs to be improved, that is, making dark displayed images darker while light displayed images lighter, in order to improve visual effect of LCD TVs.

Therefore, it is necessary to provide a technical solution to improve display contrast of liquid crystal display devices.

Technical Problem

An objective of the present disclosure is to provide a liquid crystal display device, an image displaying method thereof, and a backlight control device, and the liquid crystal display device has high display contrast.

SUMMARY OF INVENTION

An embodiment of the present disclosure provides a liquid crystal display device which comprises a backlight module, a backlight control device, and a liquid crystal display panel, wherein the backlight control device is disposed between the backlight module and the liquid crystal display panel;

the backlight module is used to output a first optical signal;

the backlight control device is used to receive an image signal and the first optical signal, to divide an image into a plurality of pixel units (j, i), to analyze pixel information of the pixel units (j, i) to correspondingly output a plurality of dimming coefficients, and to adjust the first optical signal according to the dimming coefficients to output a plurality of second optical signals;

the liquid crystal display panel is used to receive the second optical signals to display the image corresponding to the image signal;

wherein each of the pixel units (j, i) comprises at least one pixel, each of the pixel units (j, i) corresponds to each of the dimming coefficients, j represents a row where the pixel unit (j, i) is located, and i represents a column where the pixel unit (j, i) is located.

In the above liquid crystal display device, wherein the backlight control device comprises a processor and a plurality of backlight control units, the processor is used to receive the image signal, to divide the image into the plurality of pixel units (j, i), and to analyze the pixel information of the pixel units (j, i) to correspondingly output the plurality of dimming coefficients, and each of the backlight control units is used to adjust the first optical signal according to each of the dimming coefficients to correspondingly output each of the second optical signals.

In the above liquid crystal display device, wherein the processor comprises a first dimming coefficient output unit used to receive the image signal, to divide the image into the plurality of pixel units (j, i), to calculate a maximum grayscale value $Y_{max}$ and an average brightness value $Y_{av}$ of each of the pixel units (j, i), and then to calculate a first dimming coefficient L(j, i) corresponding to each of the pixel units (j, i) according to the following formula (1):

$$L(j,i)=(1-\alpha)\times Y_{av}+\alpha Y_{max} \quad (1),$$

wherein α is a weighting coefficient, when a value of $Y_{max}$ is less than or equal to a first threshold, α is 0; when the value of $Y_{max}$ is greater than or equal to a second threshold, α is 1; when the value of $Y_{max}$ is greater than the first threshold and less than the second threshold, $\alpha=kY_{max}$, wherein k is a constant greater than 0;

the first dimming coefficient L(j, i) is the dimming coefficient corresponding to each of the pixel units (j, i).

In the above liquid crystal display device, wherein the processor comprises a first dimming coefficient output unit and a spatial filter, the first dimming coefficient output unit is used to receive the image signal, to divide the image into the plurality of pixel units (j, i), to calculate a maximum grayscale value $Y_{max}$ and an average brightness values $Y_{av}$ of each of the pixel units (j, i), and then to calculate a first dimming coefficient L(j, i) corresponding to each of the pixel units (j, i) according to the following formula (1):

$$L(j,i)=(1-\alpha)\times Y_{av}+\alpha Y_{max} \quad (1),$$

wherein α is a weighting coefficient, when a value of $Y_{max}$ is less than or equal to a first threshold, α is 0; when the value of $Y_{max}$ is greater than or equal to a second threshold, α is 1; when the value of $Y_{max}$ is greater than the first threshold and less than the second threshold, $\alpha=kY_{max}$, wherein k is a constant greater than 0;

the spatial filter is used to spatial filter the first dimming coefficient L(j, i) corresponding to each of the pixel units(j, i) to output second dimming coefficients Lfin(j, i) corresponding to each of the pixel units(j, i), and the second dimming coefficients Lfin(j, i) are the dimming coefficients corresponding to each of the pixel units U, i).

In the above liquid crystal display device, wherein the spatial filter comprises a maximum neighborhood dimming coefficient computing unit, a smoothing factor computing unit, and a second dimming coefficient output unit, the maximum neighborhood dimming coefficient computing unit is used to calculate a maximum neighborhood dimming coefficient $N_{max}$ of a pixel unit (j, i) according to the following formula (2):

$$N_{max}=\max(L(j-1,i-1),L(j-1,i),L(j-1,i+1),L(j,i-1),L(j,i+1),L(j+1,i-1),L(j+1,i),L(j+1,i+1)) \quad (2),$$

wherein the L(j−1, i−1) is a first dimming coefficient of a pixel unit i−1), the L(j−1, i) is a first dimming coefficient of a pixel unit (j−1, i), the L(j−1, i+1) is a first dimming coefficient of a pixel unit (j−1, i+1), the L(j, i−1) is a first dimming coefficient of a pixel unit (j, i−1), the L(j, i+1) is a first dimming coefficient of a pixel unit (j, i+1), the L(j+1, i−1) is a first dimming coefficient of a pixel unit (j+1, i−1), the L(j+1, i) is a first dimming coefficient of a pixel unit (j+1, i), and the L(j+1, i+1) is a first dimming coefficient of a pixel unit (j+1, i+1), the smoothing factor computing unit is used to calculate a smoothing factor $sf_{max}$ of a pixel unit (j, i) according to the following formula (3):

$$sf_{max}=(1-tsf)\times N_{max} \quad (3),$$

wherein tsf is a regulation coefficient and is a constant ranging from 0 to 1, and $N_{max}$ is a maximum neighborhood dimming coefficient of a pixel unit (j, i);

the second dimming coefficient output unit is used to calculate a second dimming coefficient Lfin(j, i) of a pixel unit (j, i) according to the following formula (4):

$$Lfin(j,i)=\max(L(j,i),sf_{max}) \quad (4),$$

L(j, i) is a first dimming coefficient of a pixel unit (j, i), and $sf_{max}$ is a smoothing factor of a pixel unit (j, i).

In the above liquid crystal display device, wherein the liquid crystal display panel comprises a plurality of image display pixel units, each of the image display pixel units comprises at least one image display pixel, the image display pixel units correspond to the backlight control units by one to one and receive the second optical signals output by the corresponding backlight control units, and the image display pixel corresponds to the pixel of the image by one to one.

In the above liquid crystal display device, wherein each of the image display pixel units comprises four image display pixels, and each of the pixel units (j, i) comprises four pixels.

In the above liquid crystal display device, wherein the backlight control device comprises a liquid crystal panel, and the liquid crystal panel comprises a plurality of the backlight control units.

An embodiment of the present disclosure provides an image displaying method of a liquid crystal display device, wherein the liquid crystal display device comprises a backlight module, a backlight control device, and a liquid crystal display panel, the backlight control device is disposed between the backlight module and the liquid crystal display panel, and the method comprises following steps:

the backlight module outputting a first optical signal;

the backlight control device receiving an image signal and the first optical signal, dividing an image into a plurality of pixel units (j, i), analyzing pixel information of the pixel units (j, i) to correspondingly output a plurality of dimming coefficients, and adjusting the first optical signal according to the dimming coefficients to output a plurality of second optical signals;

the liquid crystal display panel receiving the second optical signals to display the image corresponding to the image signal;

wherein each of the pixel units (j, i) comprises at least one pixel, each of the pixel units (j, i) corresponds to each of the dimming coefficients, j represents a row where the pixel unit (j, i) is located, and i represents a column where the pixel unit (j, i) is located.

In the above image displaying method of the liquid crystal display device, wherein the backlight control device comprises a processor and a plurality of backlight control units, the processor receives the image signal, divides the image into the plurality of pixel units (j, i), and analyzes the pixel information of the pixel units (j, i) to correspondingly output the plurality of dimming coefficients, and each of the backlight control units adjusts the first optical signal according to each of the dimming coefficients to correspondingly output each of the second optical signals.

An embodiment of the present disclosure provides a backlight control device. The backlight control device is used to receive an image signal and a first optical signal, to divide an image into a plurality of pixel units (j, i), to analyze pixel information of the pixel units (j, i) to correspondingly output a plurality of dimming coefficients, and to adjust the first optical signal according to the dimming coefficients to output a plurality of second optical signals;

wherein each of the pixel units (j, i) comprises at least one pixel, each of the pixel units (j, i) corresponds to each of the dimming coefficients, j represents a row where the pixel unit (j, i) is located, and i represents a column where the pixel unit (j, i) is located.

In the above backlight control device, wherein the backlight control device comprises a processor and a plurality of backlight control units, the processor is used to receive the image signal, to divide the image into the plurality of pixel units (j, i), and to analyze the pixel information of the pixel units (j, i) to correspondingly output the plurality of dimming coefficients, and each of the backlight control units is used to adjust the first optical signal according to each of the dimming coefficients to correspondingly output each of the second optical signals.

In the above backlight control device, wherein the processor comprises a first dimming coefficient output unit used to receive the image signal, to divide the image into the plurality of pixel units (j, i), to calculate a maximum grayscale value $Y_{max}$ and an average brightness value $Y_{av}$ of each of the pixel units (j, i), and then to calculate a first dimming coefficient L(j, i) corresponding to each of the pixel units (j, i) according to the following formula (1):

$$L(j,i)=(1-\alpha)\times Y_{av}+\alpha Y_{max} \quad (1),$$

wherein α is a weighting coefficient, when a value of $Y_{max}$ is less than or equal to a first threshold, α is 0; when the value of $Y_{max}$ is greater than or equal to a second threshold, α is 1; when the value of $Y_{max}$ is greater than the first threshold and less than the second threshold, $\alpha=kY_{max}$, wherein k is a constant greater than 0;

the first dimming coefficient L(j, i) is the dimming coefficient corresponding to each of the pixel units (j, i).

In the above backlight control device, wherein the processor comprises a first dimming coefficient output unit and a spatial filter, the first dimming coefficient output unit is used to receive the image signal, to divide the image into the plurality of pixel units (j, i), to calculate a maximum grayscale value $Y_{max}$ and an average brightness value $Y_{av}$ of each of the pixel units (j, i), and then to calculate a first dimming coefficient L(j, i) corresponding to each of the pixel units (j, i) according to the following formula (1):

$$L(j,i)=(1-\alpha)\times Y_{av}+\alpha Y_{max} \quad (1),$$

wherein α is a weighting coefficient, when a value of $Y_{max}$ is less than or equal to a first threshold, α is 0; when the value of $Y_{max}$ is greater than or equal to a second threshold, α is 1; when the value of $Y_{max}$ is greater than the first threshold and less than the second threshold, $\alpha=kY_{max}$, wherein k is a constant greater than 0;

the spatial filter is used to spatial filter the first dimming coefficient L(j, i) corresponding to each of the pixel units(j, i) to output second dimming coefficients Lfin(j, i) corresponding to each of the pixel units(j, i), and the second dimming coefficients Lfin(j, i) are the dimming coefficients corresponding to each of the pixel units (j, i). the spatial filter is used to spatial filter the first dimming coefficient L(j, i) corresponding to each of the pixel units(j, i) to output second dimming coefficients Lfin(j, i) corresponding to each of the pixel units(j, i), and the second dimming coefficients Lfin(j, i) are the dimming coefficients corresponding to each of the pixel units (j, i).

In the above backlight control device, wherein the spatial filter comprises a maximum neighborhood dimming coefficient computing unit, a smoothing factor computing unit, and a second dimming coefficient output unit, the maximum neighborhood dimming coefficient computing unit is used to calculate a maximum neighborhood dimming coefficient $N_{max}$ of a pixel unit (j, i) according to the following formula (2):

$$N_{max}=\max(L(j-1,i-1),L(j-1,i),L(j-1,i+1),L(j,i-1),L(j,i+1),L(j+1,i-1),L(j+1,i),L(j+1,i+1)) \quad (2),$$

wherein the L(j−1, i−1) is a first dimming coefficient of a pixel unit i−1), the L(j−1, i) is a first dimming coefficient of a pixel unit (j−1, i), the L(j−1, i+1) is a first dimming coefficient of a pixel unit (j−1, i+1), the L(j, i−1) is a first dimming coefficient of a pixel unit (j, i−1), the L(j, i+1) is a first dimming coefficient of a pixel unit (j, i+1), the L(j+1, i−1) is a first dimming coefficient of a pixel unit (j+1, i−1), the L(j+1, i) is a first dimming coefficient of a pixel unit (j+1, i), and the L(j+1, i+1) is a first dimming coefficient of a pixel unit (j+1, i+1), the smoothing factor computing unit is used to calculate a smoothing factor $sf_{max}$ of a pixel unit (j, i) according to the following formula (3):

$$sf_{max}=(1-tsf)\times N_{max} \quad (3),$$

wherein tsf is a regulation coefficient and is a constant ranging from 0 to 1, and $N_{max}$ is a maximum neighborhood dimming coefficient of a pixel unit (j, i);

the second dimming coefficient output unit is used to calculate a second dimming coefficient Lfin(j, i) of a pixel unit (j, i) according to the following formula (4):

$$Lfin(j,i)=\max(L(j,i),sf_{max}) \quad (4),$$

L(j, i) is a first dimming coefficient of a pixel unit (j, i), and $sf_{max}$ is a smoothing factor of a pixel unit (j, i).

In the above backlight control device, wherein the backlight control device comprises a liquid crystal panel, and the liquid crystal panel comprises a plurality of the backlight control units.

Beneficial effect: the present disclosure provides a liquid crystal display device, an image displaying method thereof, and a backlight control device by disposing a backlight control device between a backlight module and a liquid crystal display panel, wherein the backlight control device divides an image into a plurality of pixel units, calculates corresponding dimming coefficients of the pixel units, and adjusts a first optical signal output by the backlight module according to the plurality of the dimming coefficients to output a plurality of second optical signals, thereby achieving local dimming and improving display contrast of liquid crystal display devices.

DETAILED DESCRIPTION OF PREFERRED EMBODIMENTS

The embodiments of the present disclosure are described in detail hereinafter. Examples of the described embodiments are given in the accompanying drawings. The specific embodiments described with reference to the attached drawings are all exemplary and are intended to illustrate and interpret the present disclosure. Based on the embodiments in the present disclosure, all other embodiments obtained by those skilled in the art without creative efforts are within the scope of the present disclosure.

Figure 1:
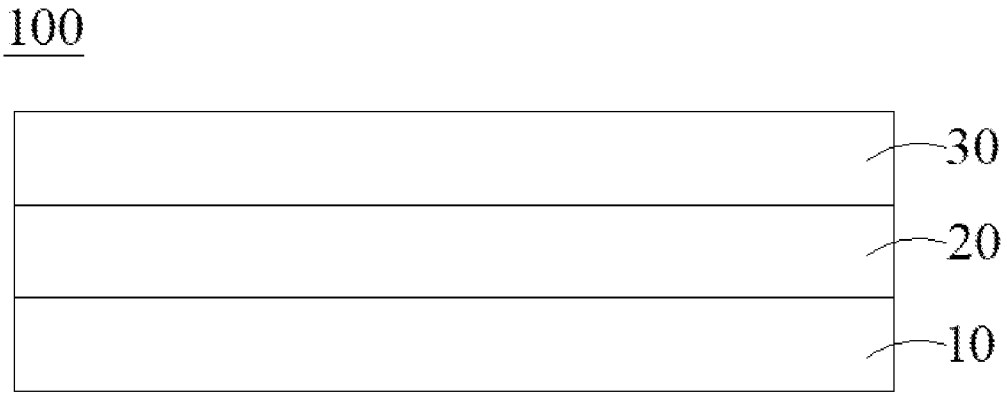
FIG. 1 is a schematic structural diagram of a liquid crystal display device according to an embodiment of the present disclosure.

Referring to FIG. 1, FIG. 1 is a schematic structural diagram of a liquid crystal display device according to an embodiment of the present disclosure. A liquid crystal display device 100 comprises a backlight module 10, a backlight control device 20, and a liquid crystal display panel 30, and the backlight control device 20 is disposed between the backlight module 10 and the liquid crystal display panel 30.

The backlight module 10 is used to output a first optical signal. The backlight module 10 comprises a light guide plate, an optical film disposed on a light-emitting surface of the light guide plate, and a light-emitting diode disposed on a light entrance surface of the light guide plate. The light-emitting diode acts as a point light source to emit light to the light guide plate, the light guide plate transforms the light emitted from the light-emitting diode into a surface light source which emits from the light-emitting surface, and the light emitted from the light guide plate is converted into a first optical signal by the optical film.

The backlight control device 20 is used to receive an image signal and the first optical signal, to divide an image into a plurality of pixel units (j, i), wherein each of the pixel units (j, i) comprises at least one pixel and each of the pixel units (j, i) corresponds to a dimming coefficient, to analyze pixel information of the pixel units (j, i) to correspondingly output a plurality of dimming coefficients, and to adjust the first optical signal according to the dimming coefficients to output a plurality of second optical signals. Wherein, j represents a row where the pixel unit (j, i) is located, and i represents a column where the pixel unit (j, i) is located.

The liquid crystal display panel 30 is used to receive the second optical signals to display the image corresponding to the image signal.

The present disclosure provides a liquid crystal display device by disposing a backlight control device between a backlight module and a liquid crystal display panel, wherein the backlight control device divides an image into a plurality of pixel units, calculates corresponding dimming coefficients of the pixel units, and adjusts a first optical signal output by the backlight module according to the plurality of the dimming coefficients to output a plurality of second optical signals, thereby achieving local dimming and improving display contrast of liquid crystal display devices. In addition, the power consumption of the liquid crystal display device can be simultaneously reduced due to local dimming. In addition, a million-level local dimming partition can make the liquid crystal display device have a million-level display contrast.

The above technical solution is further described by embodiment 1 and embodiment 2 below.

Embodiment 1

A liquid crystal display device, which comprises a backlight module, a liquid crystal display panel, and a backlight control device. The resolution of the liquid crystal display panel is 3840×RGB×2160, and the resolution of the backlight control device is 1920×1080.

The backlight control device comprises a processor and a plurality of backlight control units. The processor is used to receive an image signal, to divide the image signal into a plurality of pixel units (j, i), and to analyze pixel information of the pixel units (j, i) to correspondingly output a plurality of dimming coefficients, wherein j represents a row where the pixel unit (j, i) is located, and i represents a column where the pixel unit (j, i) is located. Each of the backlight control units is used to adjust the first optical signal according to a dimming coefficient to output a second optical signal.

The processor comprises a first dimming coefficient output unit used to receive the image signal, to divide the image into the plurality of pixel units (j, i), to calculate a maximum grayscale value $Y_{max}$ and an average brightness value $Y_{av}$ of each of the pixel units (j, i), and then to calculate a first dimming coefficient L(j, i) corresponding to each pixel unit (j, i) according to the following formula (1):

$$L(j,i)=(1-\alpha)\times Y_{av}+\alpha Y_{max} \quad (1),$$

wherein α is a weighting coefficient, when a value of $Y_{max}$ is less than or equal to a first threshold, α is 0; when the value of $Y_{max}$ is greater than or equal to a second threshold, α is 1; when the value of $Y_{max}$ is greater than the first threshold and less than the second threshold, $\alpha=kY_{max}$, wherein k is a constant greater than 0.

The physical meaning of the above formula (1) is that when a pixel in a pixel unit (j, i) has a higher brightness, it can make brightness of backlight (the second optical signals) higher to ensure the maximum brightness in the pixel unit (j, i) is not lost; when pixels in every pixel units (j, i) have a lower brightness, it can make brightness of backlight (the second optical signals) lower to ensure a darker dark state.

Specifically, a grayscale value of each pixel ranges from 0 to 1023. A large number of experiments have been performed to find that the first threshold is 10, the second threshold is 180, and the value of k is 1/170. Each pixel unit (j, i) comprises four pixels. The maximum grayscale value $Y_{max}$ of four pixels is calculated and the average brightness value $Y_{av}$ of four pixels is calculated. The value of weighting coefficient α is obtained according to the correspondence of the weighting coefficient α and the maximum grayscale value $Y_{max}$ of four pixels, and the first dimming coefficient L(j, i) of each pixel unit (j, i) is obtained by substituting the weighting coefficient α, $Y_{max}$, and $Y_{av}$ into formula (1).

The backlight control units correspond to the pixel units by one to one. Each of the backlight control units adjusts the first optical signal according to a dimming coefficient to output a second optical signal. In the embodiment, the first dimming coefficient L(j, i) is the dimming coefficient corresponding to each of the pixel units (j, i). Specifically, when the corresponding first dimming coefficient L(j, i) of the pixel unit (j, i) is 1023, the corresponding backlight control unit of the pixel unit (j, i) makes a whole amount of light of the first optical signal transmit through the backlight control unit to make the backlight control unit output the second optical signals, that is, fully transparent; when the corresponding first dimming coefficient L(j, i) of the pixel unit (j, i) is 511, the corresponding backlight control unit of the pixel unit (j, i) makes a half amount of light of the first optical signal transmit through the backlight control unit to make the backlight control unit output the second optical signals; when the corresponding first dimming coefficient L(j, i) of the pixel unit (j, i) is 0, the corresponding backlight control unit of the pixel unit (j, i) makes the first optical signal not transmit through the backlight control unit, that is, the backlight control unit is completely opaque. The correspondence of the second optical signal and the first optical signal can be inferred by scaling down when the value of the first dimming coefficient L(j, i) ranges from 1023 to 0 according to the correspondence of the second optical signal and the first optical signal when the value of the first dimming coefficient L(j, i) is 1023, 511, and 0.

It should be noted that the backlight control device may include a liquid crystal panel. The liquid crystal panel comprises a plurality of the above backlight control units and has a light-filtering effect, that is, to filter the first optical signal emitted by the backlight module to output a plurality of second optical signals. The difference of the liquid crystal panel from an ordinary liquid crystal display panel is that the liquid crystal panel has no color filter layers and only acts to adjust transmittance of light emitted from the backlight module. It should be understood that a plurality of backlight control units may also be constituted by other structures having light-filtering effect.

The liquid crystal display panel comprises a plurality of image display pixel units, each of the image display pixel units comprises at least one image display pixel, the image display pixel units correspond to the backlight control units by one to one and receive the second optical signals output by the corresponding backlight control units, that is, the image display pixel units correspond to the pixel units by one to one, and the image display pixel corresponds to the pixel of the image by one to one.

Figure 2:
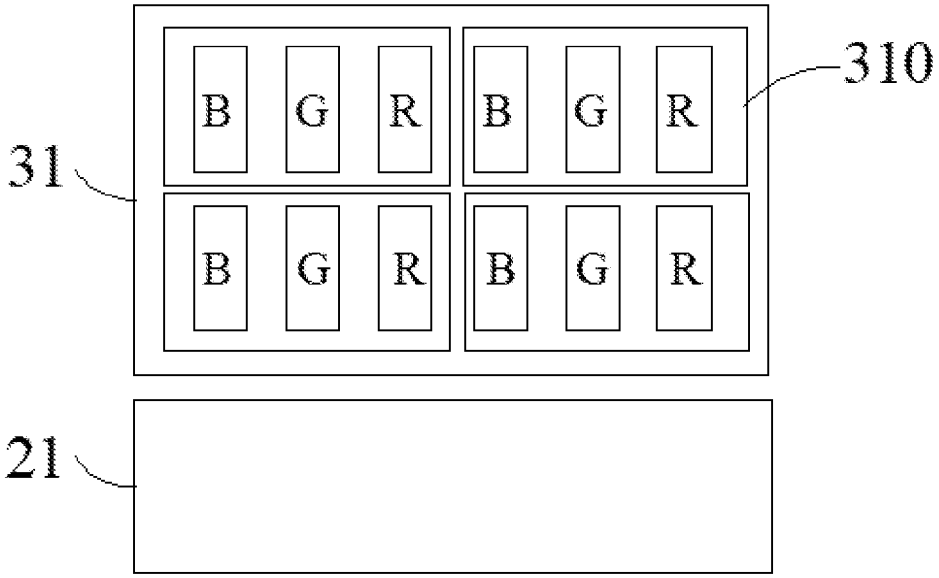
FIG. 2 is a schematic correspondence diagram of an image display pixel unit and a backlight control unit in the liquid crystal display device as shown in FIG. 1.

Specifically, as shown in FIG. 2, each image display pixel unit 31 comprises four image display pixels 310, four image display pixels 310 correspond to a backlight control unit 21, and each image display pixel 310 comprises a red image display pixel R, a green image display pixel G, and a blue image display pixel B. Each image display pixel unit on the liquid crystal display panel receives a second optical signal output by the corresponding backlight control unit to display pixel information of a pixel unit corresponding to the image display pixel unit.

Embodiment 2

The embodiment provides a liquid crystal display device. The liquid crystal display device is basically similar to that in embodiment 1, and the difference is that the processor comprises a first dimming coefficient output unit and a spatial filter, the first dimming coefficient output unit is used to receive the image signal, to divide the image into the plurality of pixel units (j, i), to calculate a maximum grayscale value $Y_{max}$ and an average brightness value $Y_{av}$ of each pixel unit (j, i), and then to calculate the corresponding first dimming coefficient L(j, i) of each pixel unit (j, i) according to the following formula (1):

$$L(j,i)=(1-\alpha)\times Y_{av}+\alpha Y_{max} \quad (1),$$

wherein α is a weighting coefficient, when a value of $Y_{max}$ is less than or equal to a first threshold, α is 0; when the value of $Y_{max}$ is greater than or equal to a second threshold, α is 1; when the value of $Y_{max}$ is greater than the first threshold and less than the second threshold, $\alpha=kY_{max}$, wherein k is a constant greater than 0.

The spatial filter is used to spatial filter the corresponding first dimming coefficient L(j, i) of each pixel unit (j, i) to output the corresponding second dimming coefficient Lfin(j, i) of each pixel unit (j, i).

In the embodiment, the spatial filter comprises a maximum neighborhood dimming coefficient computing unit, a smoothing factor computing unit, and a second dimming coefficient output unit;

the maximum neighborhood dimming coefficient computing unit is used to calculate a maximum neighborhood dimming coefficient $N_{max}$ of a pixel unit (j, i) according to the following formula (2):

$$N_{max}=\max(L(j-1,i-1),L(j-1,i),L(j-1,i+1),L(j,i-1),L(j,i+1),L(j+1,i-1),L(j+1,i),L(j+1,i+1)) \quad (2),$$

wherein the L(j−1, i−1) is a first dimming coefficient of a pixel unit i−1), the L(j−1, i) is a first dimming coefficient of a pixel unit (j−1, i), the L(j−1, i+1) is a first dimming coefficient of a pixel unit (j−1, i+1), the L(j, i−1) is a first dimming coefficient of a pixel unit (j, i−1), the L(j, i+1) is a first dimming coefficient of a pixel unit (j, i+1), the L(j+1, i−1) is a first dimming coefficient of a pixel unit (j+1, i−1), the L(j+1, i) is a first dimming coefficient of a pixel unit (j+1, i), and the L(j+1, i+1) is a first dimming coefficient of a pixel unit (j+1, i+1), the smoothing factor computing unit is used to calculate a smoothing factor $sf_{max}$ of a pixel unit (j, i) according to the following formula (3):

$$sf_{max}=(1-tsf)\times N_{max} \quad (3),$$

wherein tsf is a regulation coefficient and is a constant ranging from 0 to 1, and $N_{max}$ is a maximum neighborhood dimming coefficient of a pixel unit (j, i);

the second dimming coefficient output unit is used to calculate a second dimming coefficient Lfin(j, i) of a pixel unit (j, i) according to the following formula (4):

$$Lfin(j,i)=\max(L(j,i),sf_{max}) \quad (4),$$

L(j, i) is a first dimming coefficient of a pixel unit (j, i), and $sf_{max}$ is a smoothing factor of a pixel unit (j, i).

Compared to the liquid crystal display device in embodiment 1, the liquid crystal display device in embodiment 2 improves viewing angles of liquid crystal display devices by spatial filtering a plurality of first dimming coefficients to obtain a plurality of second dimming coefficients.

Embodiment 3

Figure 3:
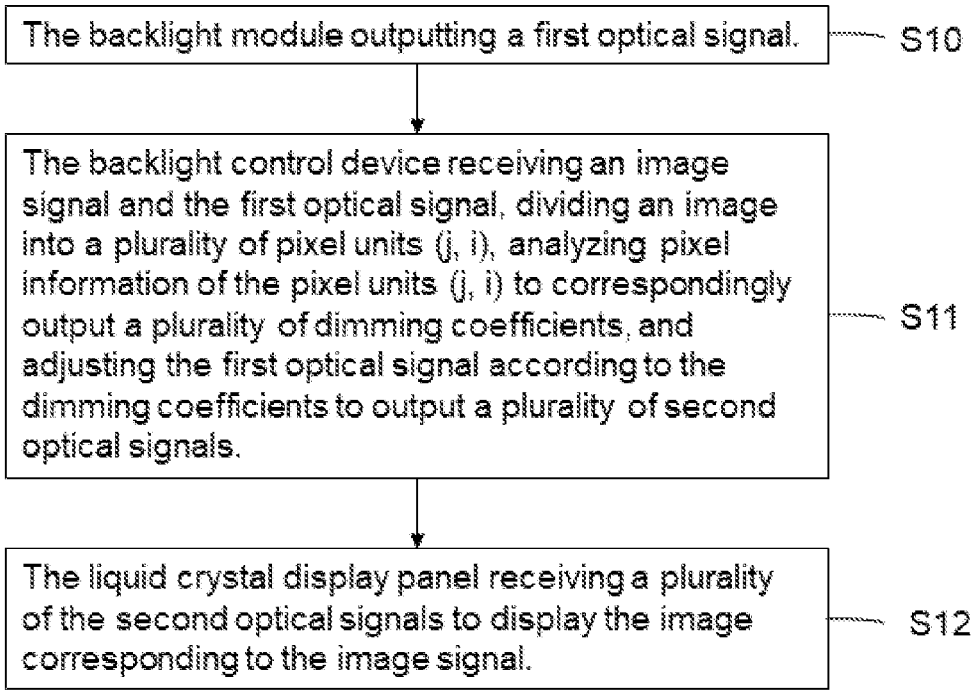
FIG. 3 is a flowchart of an image displaying method of a liquid crystal display device according to an embodiment of the present disclosure.

As shown in FIG. 3, FIG. 3 is a flowchart of an image displaying method of a liquid crystal display device according to an embodiment of the present disclosure. The liquid crystal display device comprises a backlight module, a backlight control device, and a liquid crystal display panel, the backlight control device is disposed between the backlight module and the liquid crystal display panel, and the method comprises following steps:

S10: the backlight module outputting a first optical signal;

S11: the backlight control device receiving an image signal and the first optical signal, dividing an image into a plurality of pixel units (j, i), analyzing pixel information of the pixel units (j, i) to correspondingly output a plurality of dimming coefficients, and adjusting the first optical signal according to the dimming coefficients to output a plurality of second optical signals;

S12: the liquid crystal display panel receiving a plurality of the second optical signals to display the image corresponding to the image signal.

Each of the pixel units (j, i) comprises at least one pixel, each of the pixel units (j, i) corresponds to each of the dimming coefficients, j represents a row where the pixel unit (j, i) is located, and i represents a column where the pixel unit (j, i) is located.

In the embodiment, the backlight control device comprises a processor and a plurality of backlight control units. The processor receives an image signal, divides an image into a plurality of pixel units (j, i), and analyzes pixel information of the pixel units (j, i) to correspondingly output a plurality of dimming coefficients. Each backlight control unit adjusts the first optical signal according to a dimming coefficient to output a second optical signal.

In the embodiment, the processor comprises a first dimming coefficient output unit used to receive the image signal, to divide the image into the plurality of pixel units (j, i), to calculate a maximum grayscale value $Y_{max}$ and an average brightness value $Y_{av}$ of each pixel unit (j, i), and then to calculate a first dimming coefficient L(j, i) corresponding to each pixel unit (j, i) according to the following formula (1):

$$L(j,i)=(1-\alpha)\times Y_{av}+\alpha Y_{max} \quad (1),$$

wherein α is a weighting coefficient, when a value of $Y_{max}$ is less than or equal to a first threshold, α is 0; when the value of $Y_{max}$ is greater than or equal to a second threshold, α is 1; when the value of $Y_{max}$ is greater than the first threshold and less than the second threshold, $\alpha=kY_{max}$, wherein k is a constant greater than 0.

The first dimming coefficient L(j, i) is the corresponding dimming coefficient of each pixel unit (j, i).

In other embodiments, the processor further comprises a spatial filter. The spatial filter is used to spatial filter the first dimming coefficient L(j, i) corresponding to each of the pixel units (j, i) to output the corresponding second dimming coefficients Lfin(j, i) of each of the pixel units(j, i), and the second dimming coefficients Lfin(j, i) are the dimming coefficients corresponding to each of the pixel units (j, i).

The present disclosure provides an image displaying method of the liquid crystal display device by disposing a backlight control device between a backlight module and a liquid crystal display panel, wherein the backlight control device divides an image into a plurality of pixel units, calculates corresponding dimming coefficients of the pixel units, and adjusts a first optical signal output by the backlight module according to the plurality of the dimming coefficients to output a plurality of second optical signals, thereby achieving local dimming and improving display contrast of liquid crystal display devices.

Embodiment 4

The embodiment of the present disclosure provides a backlight control device. The backlight control device is used to receive an image signal and a first optical signal, to divide an image into a plurality of pixel units (j, i), to analyze pixel information of the pixel units (j, i) to correspondingly output a plurality of dimming coefficients, and to adjust the first optical signal according to the dimming coefficients to output a plurality of second optical signals. Wherein, each of the pixel units (j, i) comprises at least one pixel, each of the pixel units (j, i) corresponds to a dimming coefficient, j represents a row where the pixel unit (j, i) is located, and i represents a column where the pixel unit (j, i) is located.

The present disclosure provides a backlight control device by dividing an image into a plurality of pixel units, calculating corresponding dimming coefficients of each of the pixel units, and adjusting a first optical signal input into a backlight control unit according to a plurality of dimming coefficients to output a plurality of second optical signals, thereby achieving local dimming and improving display contrast of liquid crystal display devices when the backlight control device is used in a liquid crystal display device.

The description of the above embodiments is only for helping to understand the technical solution of the present disclosure and its core ideas, and it is understood that many changes and modifications to the described embodiment can be carried out without departing from the scope and the spirit of the disclosure that is intended to be limited only by the appended claims.

What is claimed is:

1. A liquid crystal display device, comprising a backlight module, a backlight control device, and a liquid crystal display panel, wherein the backlight control device is disposed between the backlight module and the liquid crystal display panel;

the backlight module is used to output a first optical signal;

the backlight control device is used to receive an image signal and the first optical signal, to divide an image into a plurality of pixel units (j, i), to analyze pixel information of the pixel units (j, i) to correspondingly output a plurality of dimming coefficients, and to adjust the first optical signal according to the dimming coefficients to output a plurality of second optical signals; and the liquid crystal display panel is used to receive the second optical signals to display the image corresponding to the image signal;

wherein each of the pixel units (j, i) comprises at least one pixel, each of the pixel units (j, i) corresponds to each of the dimming coefficients, j represents a row where the pixel unit (j, i) is located, and i represents a column where the pixel unit (j, i) is located, wherein the backlight control device comprises a processor and a plurality of backlight control units, the processor is used to receive the image signal, to divide the image into the plurality of pixel units (j, i), and to analyze the pixel information of the pixel units (j, i) to correspondingly output the plurality of dimming coefficients, and each of the backlight control units is used to adjust the first optical signal according to each of the dimming coefficients to correspondingly output each of the second optical signals, and wherein the processor comprises a first dimming coefficient output unit used to receive the image signal, to divide the image into the plurality of pixel units (j, i), to calculate a maximum grayscale value $Y_{max}$ and an average brightness value $Y_{av}$ each of the pixel units (j, i), and then to calculate a first dimming coefficient L(j, i) corresponding to each of the pixel units (j, i) according to a following formula (1):

$$L(j,i)=(1-\alpha)\times Y_{av}+\alpha Y_{max} \quad (1),$$

wherein α is a weighting coefficient, when a value of $Y_{max}$ is less than or equal to a first threshold, α is 0; when the value of $Y_{max}$ is greater than or equal to a second threshold, α is 1; and when the value of $Y_{max}$ is greater than the first threshold and less than the second threshold, $\alpha=kY_{max}$, wherein k is a constant greater than 0; and the first dimming coefficient L(j, i) is the dimming coefficient corresponding to each of the pixel units (j, i).

2. The liquid crystal display device according to claim 1, wherein the processor comprises a first dimming coefficient output unit and a spatial filter, the first dimming coefficient output unit is used to receive the image signal, to divide the image into the plurality of pixel units (j, i), to calculate a maximum grayscale value $Y_{max}$ and an average brightness value $Y_{av}$ of each of the pixel units (j, i), and then to calculate a first dimming coefficient L(j, i) corresponding to each of the pixel units (j, i) according to a following formula (1):

$$L(j,i)=(1-\alpha)\times Y_{av}+\alpha Y_{max} \quad (1),$$

wherein α is a weighting coefficient, when a value of $Y_{max}$ is less than or equal to a first threshold, α is 0; when the value of $Y_{max}$ is greater than or equal to a second threshold, α is 1; and when the value of $Y_{max}$ is greater than the first threshold and less than the second threshold, $\alpha=kY_{max}$, wherein k is a constant greater than 0; and the spatial filter is used to spatial filter the first dimming coefficient L(j, i) corresponding to each of the pixel units(j, i) to output a second dimming coefficient Lfin(j, i) corresponding to each of the pixel units(j, i), and the second dimming coefficient Lfin(j, i) is the dimming coefficient corresponding to each of the pixel units (j, i).

3. The liquid crystal display device according to claim 2, wherein the spatial filter comprises a maximum neighborhood dimming coefficient computing unit, a smoothing factor computing unit, and a second dimming coefficient output unit, the maximum neighborhood dimming coefficient computing unit is used to calculate a maximum neighborhood dimming coefficient $N_{max}$ of the pixel unit (j, i) according to a following formula (2):

$$N_{max}\ \max(L(j-1,i-1),L(j-1,i),L(j-1,i+1),L(j,i-1),L(j,i+1),L(j+1,i-1),L(j+1,i),L(j+1,i+1)) \quad (2),$$

wherein the L(j−1, i−1) is a first dimming coefficient of a pixel unit (j−1, i−1), the L(j−1, i) is a first dimming coefficient of a pixel unit (j−1, i), the L(j−1, i+1) is a first dimming coefficient of a pixel unit (j−1, i+1), the L(j, i−1) is a first dimming coefficient of a pixel unit (j, i−1), the L(j, i+1) is a first dimming coefficient of a pixel unit (j, i+1), the L(j+1, i−1) is a first dimming coefficient of a pixel unit (j+1, i−1), the L(j+1, i) is a first dimming coefficient of a pixel unit (j+1, i), and the L(j+1, i+1) is a first dimming coefficient of a pixel unit (j+1, i+1);

the smoothing factor computing unit is used to calculate a smoothing factor $sf_{max}$ of the pixel unit (j, i) according to a following formula (3):

$$sf_{max}=(1-tsf)\times N_{max} \quad (3),$$

wherein tsf is a regulation coefficient and is a constant ranging from 0 to 1, and $N_{max}$ is the maximum neighborhood dimming coefficient of the pixel unit (j, i); and the second dimming coefficient output unit is used to calculate the second dimming coefficient Lfin(j, i) of the pixel unit (j, i) according to a following formula (4):

$$Lfin(j,i)=\max(L(j,i),sf_{max}) \quad (4),$$

wherein L(j, i) is the first dimming coefficient of the pixel unit (j, i), and $sf_{max}$ is the smoothing factor of the pixel unit (j, i).

4. The liquid crystal display device according to claim 1, wherein the liquid crystal display panel comprises a plurality of image display pixel units, each of the image display pixel units comprises at least one image display pixel, the image display pixel units correspond to the backlight control units by one to one and receive the second optical signals output by the corresponding backlight control units, and the at least one image display pixel corresponds to the pixel of the image by one to one.

5. The liquid crystal display device according to claim 4, wherein each of the image display pixel units comprises four image display pixels, and each of the pixel units (j, i) comprises four pixels.

6. The liquid crystal display device according to claim 1, wherein the backlight control device comprises a liquid crystal panel, and the liquid crystal panel comprises the plurality of backlight control units.

7. An image displaying method of a liquid crystal display device, wherein the liquid crystal display device comprises a backlight module, a backlight control device, and a liquid crystal display panel, the backlight control device is disposed between the backlight module and the liquid crystal display panel, and the method comprises following steps:

the backlight module outputting a first optical signal;

the backlight control device receiving an image signal and the first optical signal, dividing an image into a plurality of pixel units (j, i), analyzing pixel information of the pixel units (j, i) to correspondingly output a plurality of dimming coefficients, and adjusting the first optical signal according to the dimming coefficients to output a plurality of second optical signals; and the liquid crystal display panel receiving the second optical signals to display the image corresponding to the image signal;

wherein each of the pixel units (j, i) comprises at least one pixel, each of the pixel units (j, i) corresponds to each of the dimming coefficients, j represents a row where the pixel unit (j, i) is located, and i represents a column where the pixel unit (j, i) is located, wherein the backlight control device comprises a processor and a plurality of backlight control units, the processor receives the image signal, divides the image into the plurality of pixel units (j, i), and analyzes the pixel information of the pixel units (j, i) to correspondingly output the plurality of dimming coefficients, and each of the backlight control units adjusts the first optical signal according to each of the dimming coefficients to correspondingly output each of the second optical signals, and wherein the processor comprises a first dimming coefficient output unit used to receive the image signal, to divide the image into the plurality of pixel units (j, i), to calculate a maximum grayscale value $Y_{max}$ and an average brightness value $Y_{av}$ of each of the pixel units (j, i), and then to calculate a first dimming coefficient L(j, i) corresponding to each of the pixel units (j, i) according to a following formula (1):

$$L(i,i)=(1-\alpha)\times Y_{av}+\alpha Y_{max} \quad (1),$$

wherein α is a weighting coefficient, when a value of $Y_{max}$ is less than or equal to a first threshold, α is 0; when the value of $Y_{max}$ is greater than or equal to a second threshold, α is 1; and when the value of $Y_{max}$ is greater than the first threshold and less than the second threshold, $\alpha=kY_{max}$, wherein k is a constant greater than 0; and the first dimming coefficient L(j, i) is the dimming coefficient corresponding to each of the pixel units (j, i).

8. A backlight control device, used to receive an image signal and a first optical signal, to divide an image into a plurality of pixel units (j, i), to analyze pixel information of the pixel units (j, i) to correspondingly output a plurality of dimming coefficients, and to adjust the first optical signal according to the dimming coefficients to output a plurality of second optical signals;

wherein each of the pixel units (j, i) comprises at least one pixel, each of the pixel units (j, i) corresponds to each of the dimming coefficients, j represents a row where the pixel unit (j, i) is located, and i represents a column where the pixel unit (j, i) is located, wherein the backlight control device comprises a processor and a plurality of backlight control units, wherein the processor is used to receive the image signal, to divide the image into the plurality of pixel units (j, i), and to analyze the pixel information of the pixel units (j, i) to correspondingly output the plurality of dimming coefficients, and each of the backlight control units is used to adjust the first optical signal according to each of the dimming coefficients to correspondingly output each of the second optical signals, and wherein the processor comprises a first dimming coefficient output unit used to receive the image signal, to divide the image into the plurality of pixel units (j, i), to calculate a maximum grayscale value Ymax and an average brightness value Yav of each of the pixel units (j, i), and then to calculate a first dimming coefficient L(j, i) corresponding to each of the pixel units (j, i) according to a following formula (1):

$$L(j,i)=(1-\alpha)\times Yav+\alpha Ymax \quad (1),$$

wherein α is a weighting coefficient, when a value of Ymax is less than or equal to a first threshold, α is 0; when the value of Ymax is greater than or equal to a second threshold, α is 1; and when the value of Ymax is greater than the first threshold and less than the second threshold, α=kYmax, wherein k is a constant greater than 0; and the first dimming coefficient L(j, i) is the dimming coefficient corresponding to each of the pixel units (j, i).

9. The backlight control device according to claim 8, wherein the processor comprises a spatial filter, the spatial filter is used to spatial filter the first dimming coefficient L(j, i) corresponding to each of the pixel units(j, i) to output a second dimming coefficient Lfin(j, i) corresponding to each of the pixel units(j, i), and the second dimming coefficient Lfin(j, i) is the dimming coefficient corresponding to each of the pixel units (j, i).

10. The backlight control device according to claim 9, wherein the spatial filter comprises a maximum neighborhood dimming coefficient computing unit, a smoothing factor computing unit, and a second dimming coefficient output unit, the maximum neighborhood dimming coefficient computing unit is used to calculate a maximum neighborhood dimming coefficient $N_{max}$ of the pixel unit (j, i) according to a following formula (2):

$$N_{max}\max(L(j-1,i-1),L(j-1,i),L(j-1,i+1),L(j,i-1),L(j,i+1),L(j+1,i-1),L(j+1,i),L(j+1,i+1)) \quad (2),$$

wherein the L(j−1, i−1) is a first dimming coefficient of a pixel unit (j−1, i−1), the L(j−1, i) is a first dimming coefficient of a pixel unit (j−1, i), the L(j−1, i+1) is a first dimming coefficient of a pixel unit (j−1, i+1), the L(j, i−1) is a first dimming coefficient of a pixel unit (j, i−1), the L(j, i+1) is a first dimming coefficient of a pixel unit (j, i+1), the L(j+1, i−1) is a first dimming coefficient of a pixel unit (j+1, i−1), the L(j+1, i) is a first dimming coefficient of a pixel unit (j+1, i), and the L(j+1, i+1) is a first dimming coefficient of a pixel unit (j+1, i+1);

the smoothing factor computing unit is used to calculate a smoothing factor $sf_{max}$ of the pixel unit (j, i) according to a following formula (3):

$$sf_{max}=(1-tsf)\times N_{max} \quad (3),$$

wherein tsf is a regulation coefficient and is a constant ranging from 0 to 1, and $N_{max}$ is the maximum neighborhood dimming coefficient of the pixel unit (j, i);

the second dimming coefficient output unit is used to calculate the second dimming coefficient Lfin(j, i) of the pixel unit (j, i) according to a following formula (4):

$$Lfin(j,i)=\max(L(j,i),sf_{max}) \quad (4),$$

wherein L(j, i) is the first dimming coefficient of the pixel unit (j, i), and $sf_{max}$ is the smoothing factor of the pixel unit (j, i).

11. The backlight control device according to claim 8, comprising a liquid crystal panel, and the liquid crystal panel comprises a plurality of backlight control units.

* * * * *